US007077036B1

(12) United States Patent
Adams

(10) Patent No.: US 7,077,036 B1
(45) Date of Patent: Jul. 18, 2006

(54) TIMING GEAR PLIERS

(76) Inventor: James Adams, 3748 Timahoe Cir., Baltimore, MD (US) 21236

( * ) Notice: Subject to any disclaimer, the term of this patent is extended or adjusted under 35 U.S.C. 154(b) by 0 days.

(21) Appl. No.: 11/230,197

(22) Filed: Sep. 20, 2005

Related U.S. Application Data

(60) Provisional application No. 60/612,163, filed on Sep. 23, 2004.

(51) Int. Cl.
*B25B 1/00* (2006.01)

(52) U.S. Cl. ..... 81/426.5; 81/427; 81/423; 269/156; 30/260

(58) Field of Classification Search ..... 81/418, 81/421, 423, 424.5, 426, 427; 269/156, 238, 269/275, 138; 30/260; 72/409.16
See application file for complete search history.

(56) References Cited

U.S. PATENT DOCUMENTS

| | | | | |
|---|---|---|---|---|
| 1,910,750 | A | | 5/1933 | Clark |
| 5,063,770 | A | * | 11/1991 | Chen ..... 72/409.11 |
| 5,255,579 | A | * | 10/1993 | Fortin ..... 81/424 |
| 5,285,703 | A | * | 2/1994 | Carson ..... 81/423 |
| 5,876,026 | A | * | 3/1999 | Chen ..... 269/156 |
| 6,327,944 | B1 | | 12/2001 | Liao |
| 6,345,558 | B1 | | 2/2002 | Wilson |
| 6,487,942 | B1 | | 12/2002 | Carter et al. |

* cited by examiner

*Primary Examiner*—Lee D. Wilson
*Assistant Examiner*—Anthony Ojini
(74) *Attorney, Agent, or Firm*—Patent & Trademark Services, Inc.; Joseph H. McGlynn

(57) ABSTRACT

A set of pliers that have a plurality of pins on the forward parts of the plier arms and removable blocks which have apertures that can be placed on selected ones of the pins. The blocks have teeth that can engage the teeth on a timing gear.

12 Claims, 2 Drawing Sheets

TIMING GEAR PLIERS

Applicant claims Priority of Provisional application of Ser. No. 60/612,163, filed Sep. 23, 2004.

BACKGROUND OF THE INVENTION

This invention relates, in general, to hand tools, and, in particular, to timing gear pliers.

DESCRIPTION OF THE PRIOR ART

In the prior art various types of hand tools have been proposed. For example, U.S. Pat. No. 1,910,750 to Clark discloses pliers which have fixed teeth on the arms for holding circular objects.

U.S. Pat. No. 6,345,558 to Wilson discloses pliers with arms bent at a right engage to engage with teeth on a gear.

U.S. Pat. No. 6,487,942 to Carter et al discloses adjustable pliers which have fixed teeth on the arms for holding circular objects.

U.S. Pat. No. 6,327,944 to Liao discloses adjustable pliers made in layers with fixed teeth on the arms.

SUMMARY OF THE INVENTION

The present invention is directed to a set of pliers that have a plurality of pins on the forward parts of the plier arms and removable blocks which have apertures that can be placed on selected pins. The blocks have teeth that can engage the teeth on a timing gear.

It is an object of the present invention to provide a new and improved hand tool.

It is an object of the present invention to provide a new and improved timing gear pliers that are adjustable to hold different size timing gears.

It is an object of the present invention to provide a new and improved timing gear pliers that are inexpensive to manufacture and easy to operate in close quarters.

These and other objects and advantages of the present invention will be fully apparent from the following description, when taken in connection with the annexed drawings.

DESCRIPTION OF THE PREFERRED EMBODIMENT

Timing gear pliers are used to hold a timing gear after the timing belt has been removed. The gear nut 12 (see FIG. 2) can then be removed for oil seal replacement, which is located behind the gear. The gear 10 can be reinstalled after replacement of the seal and torqued to specification. The timing gear is connected to the cam shaft which operates the movement of the valves. It is crucial on most vehicles that the gear does not move when the timing belt has been removed because of the possible valve/piston interference. On noninterference motors the timing gear pliers can also be used to safely adjust the gears for proper alignment. The pliers 1 of the present invention provide a quick and safe method of holding the gear, and the pliers can be easily adjusted for different size gears.

Figure 1:
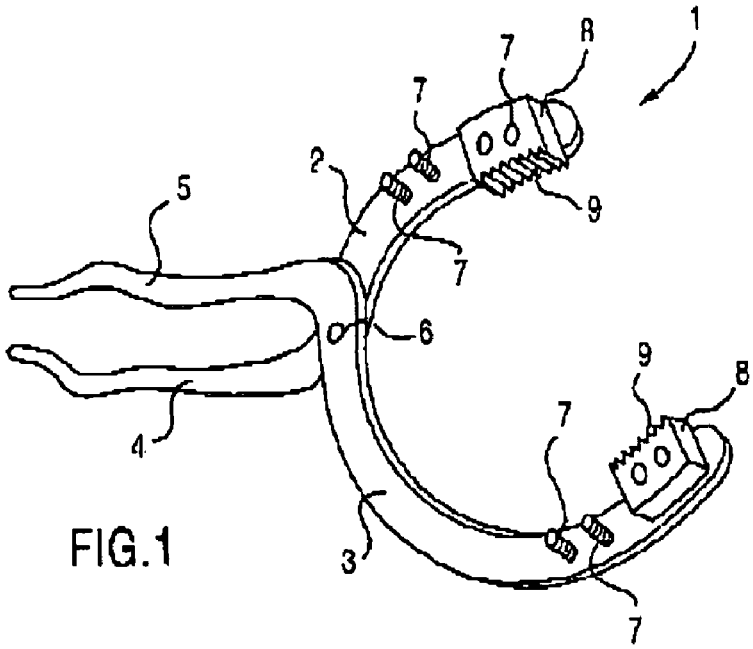
FIG. 1 is a perspective view of the present invention.

Referring now to the drawings in greater detail, FIG. 1 shows the present invention 1. The pliers 1 have a first arm 2, 4 which is pivoted to a second arm 3, 5 at 6 in any conventional manner. It should be noted the exact shape of the arms 4, 5 can vary without departing from the scope of the present invention. Also, the pivot point 6 does not have to be a fixed point. It can be an adjustable pivot similar to the adjusting pivot point on regular pliers.

Each of the arm sections 2, 3 have ends which are remote from the arm sections 4, 5. These ends have a plurality of pins or protrusions 7 permanently affixed to the arms in any conventional manner. The pins 7 are perpendicular to the arm sections 2, 3. A block 8 has at least a pair of apertures that fit onto the pins 7 in order to secure each of the blocks 8 to the pins 7, and in turn to the arm sections 2, 3. The blocks have a series of teeth, or other type of roughened surface, 9 in order to provide better gripping power for the pliers. It should be noted that the roughened surface 9 could be designed as teeth that mesh with the teeth 11 on the gear 10 in order to secure the pliers firmly on the gear (see FIG. 2). In the alternative, the roughened surface 9 could be just a rough holding surface without any meshing with the teeth on the gear 10.

Since there are more pins 7 on the arm sections 2, 3 than there are apertures in the blocks 8, the blocks can be removed from the location on the arms, as shown in FIG. 1, and moved to a new location on the arm sections. This will allow the pliers to be adjusted to fit different size gears. Also, it should be noted that the blocks are located almost entirely adjacent a side surface of the arm sections 2, 3. This means that very little of the blocks 8 protrude past the side surfaces of the arm sections. This allows the pliers to be used in locations with tight clearances that would not be possible if the blocks were attached to an inside portion of the arms, that is the portion of the arm sections which face each other.

Figure 2:
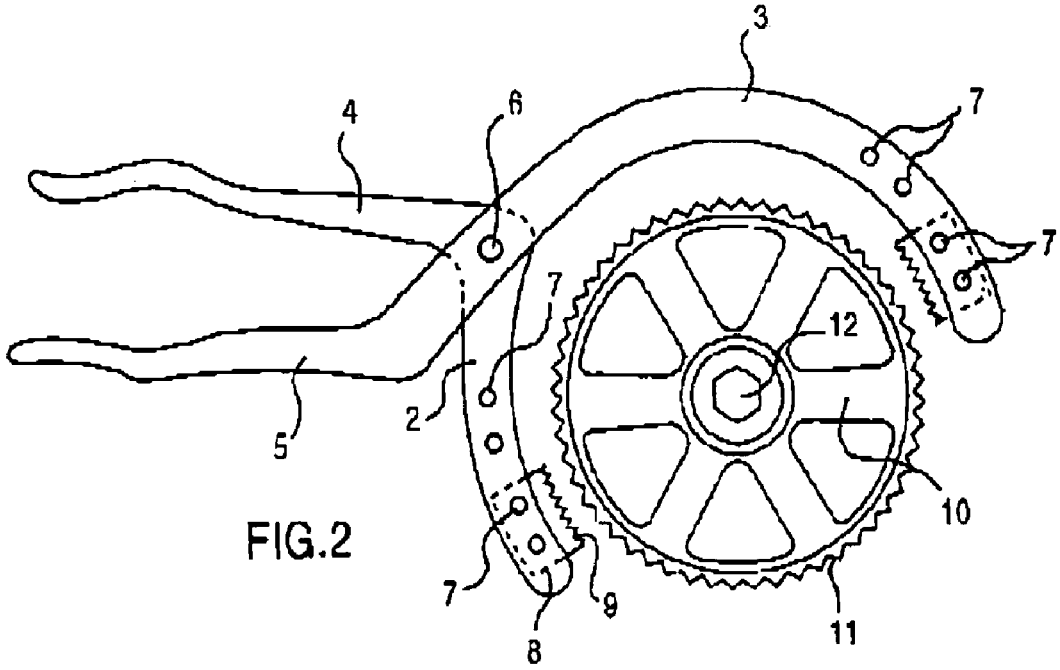
FIG. 2 is a side view of the present invention as the pliers are about to be applied to a timing gear.

It should be noted that while the pliers 1 has been described with respect to a timing gear, they have other uses. For example, they could be used to hold a serpentine belt pulley by making the grooves 9 in the block 8 run parallel to the length of the arms 2, 3 instead of perpendicular to the length of the arms 2, 3, as shown in FIG. 2.

Figure 3:
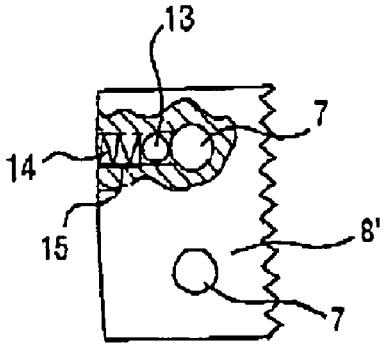
FIG. 3 is a partial view of the blocks of the present invention showing a locking mechanism for holding the blocks on the pins.

FIG. 3 shows an alternative way of securing the blocks to the pins. The alternative block 8' has an additional aperture which is perpendicular to the apertures which receive the pins 7. The additional aperture has a captive ball 13 which can protrude at least partially from the additional aperture. The ball 13 is forced out of the additional aperture by a spring 14. The spring 14 forces the ball 13 against the pin 7 to help hold the block 8' onto the pins 7. It should be noted that only one additional aperture is shown in block 8', however, more than one additional aperture can be used without departing from the scope of the invention.

Figure 4:
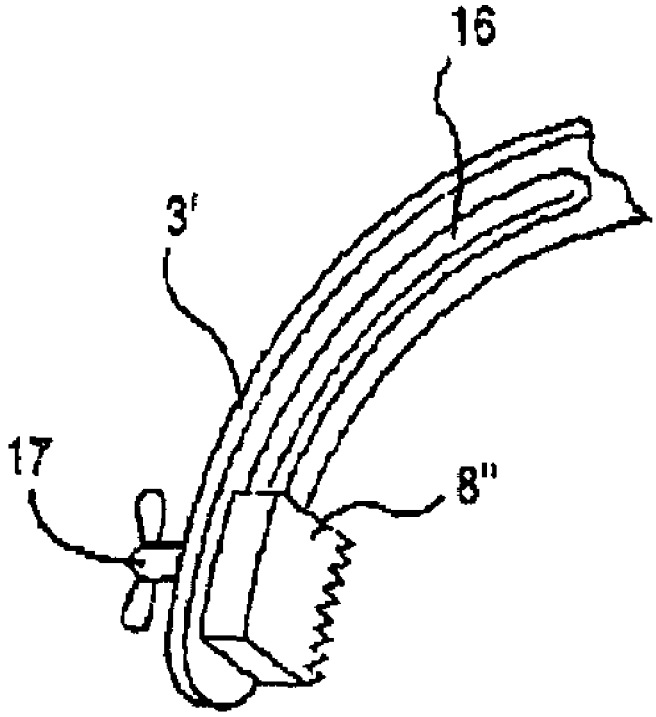
FIG. 4 is a partial perspective view of an alternative arm for the pliers of the present invention.

FIG. 4 shows an alternative arm for the pliers. This arm section 3' has a slot 16 that runs along the length of the arm and extends through the thickness of the arm. The modified block 8" is similar to the blocks 8 and 8' except block 8" does not have apertures to receive the pins. In fact, the modified arm section 3' has no pins. Instead it has a slot 16 and a bolt (hidden in FIG. 4) that extends from the back of block 8". The bolt receives a wing nut 17 to tighten the block against the arm section 3' and lock the block 8" in position along the slot 16. Although only one arm section 3' of the pliers is shown in FIG. 4, it should be understood that a similar arrangement could be applied to the other arm section of the pliers. The slot allows greater versatility in positioning the block along the arms of the pliers.

Figure 5:
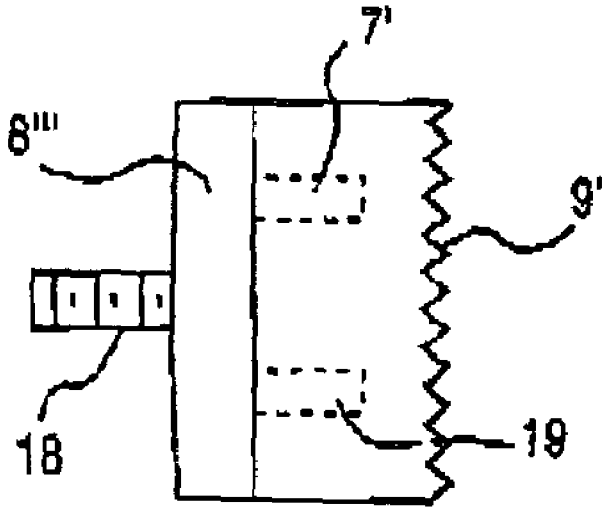
FIG. 5 is a side view of an alternative block for the pliers of the present invention.

FIG. 5 shows another type of block that can be used with the present invention. In the FIG. 5 device the block is actually made of two blocks 8''' and 19. The block 8''' has pins 7' similar to the pins 7. The pins 7' are inserted into apertures in block 19 which has teeth 9'. Threaded bolt 18 is inserted through slot 16 and is secured with a wing nut 17 as shown in FIG. 4. It should be noted that the pins 7' could be on the block 19 instead of on the block 8'''.

Although the Timing Gear Pliers and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A manually operated device for rapidly grasping and securely holding different sizes of gears, said device comprising:

a first arm, said first arm having two sections, a second arm, said second arm having two sections, said first and second arms being pivotally secured together, at least one block, said at least one block having means for securing said at least one block to said first or second arms, and wherein said means for securing said at least one block to said first or second arms comprises:

one section of said first arm having at least a pair of protrusions affixed thereto, one section of said second arm having at least a pair of protrusions affixed thereto, and said at least one block has means for receiving said at least a pair of protrusions, and wherein said means for receiving said at least a pair of protrusions is a pair of apertures, and wherein said at least one block has at least one additional aperture, and wherein said at least one additional aperture has a spring biased detent therein.

2. The manually operated device as claimed in claim 1, wherein said at least one block has a roughened surface.

3. The manually operated device as claimed in claim 2, wherein said roughened surface comprises teeth.

4. A manually operated device for rapidly grasping and securely holding different sizes of gears, said device comprising:

a first arm, said first arm having two sections, a second arm, said second arm having two sections, said first and second arms being pivotally secured together, at least one block, said at least one block having means for securing said at least one block to said first or second arms, and wherein said means for securing said at least one block to said first or second arms comprises:

one section of said first arm having at least a pair of protrusions affixed thereto, one section of said second arm having at least a pair of protrusions affixed thereto, and said at least one block has means for receiving said at least a pair of protrusions, and wherein said means for securing said at least one block to said first or second arms comprises:

one section of said first arm having two pair of protrusions affixed thereto, one section of said second arm having two pair of protrusions affixed thereto, and said at least one block has means for receiving only one of said two pair of protrusions at a time.

5. The manually operated device as claimed in claim 4, wherein said means for securing said at least one block to said first or second arms comprises:

a slot extending along said first or second arms, and said at least one block has means for securing said at least one block at a plurality of positions along said slot.

6. A manually operated device for rapidly grasping and securely holding different sizes of gears, said device comprising:

a first arm, said first arm having two sections, a second arm, said second arm having two sections, said first and second arms being pivotally secured together, at least one block, said at least one block having means for securing said at least one block to said first or second arms, and wherein said at least one block is comprised of two sections, one of said two sections having a pair of protrusions extending from one surface and a single protrusion extending from another surface, and means for securing said two sections together.

7. The manually operated device as claimed in claim 6, wherein said means for securing said two sections together is a pair of apertures for receiving said pair of protrusions.

8. The manually operated device as claimed in claim 6, wherein said single protrusion is threaded.

9. The manually operated device as claimed in claim 6, wherein each of said two blocks has a roughened surface.

10. The manually operated device as claimed in claim 9, wherein said roughened surface comprises teeth.

11. The manually operated device as claimed in claim 10, wherein said teeth extend parallel to said protrusions.

12. The manually operated device as claimed in claim 6, wherein each of said two blocks is comprised of two sections, one of said two sections having a pair of protrusions extending from one surface and a single protrusion extending from another surface, and each of said two blocks has a pair of apertures for receiving said pair of protrusions, and wherein said single protrusion is threaded.

* * * * *